United States Patent [19]

Olson

[11] Patent Number: 4,506,496

[45] Date of Patent: Mar. 26, 1985

[54] HAND GRIP AND STIRRUP SUPPORT DEVICE FOR BAREBACK HORSE RIDING

[76] Inventor: Darrel L. Olson, 2041 5th Ave., Greeley, Colo. 80631

[21] Appl. No.: 577,206

[22] Filed: Feb. 6, 1984

[51] Int. Cl.[3] ..... B68B 1/02; B68B 1/16

[52] U.S. Cl. ..... 54/44

[58] Field of Search ..... 54/23, 37, 38, 44, 46, 54/47, 65, 66

[56] References Cited

U.S. PATENT DOCUMENTS

| | | | |
|---|---|---|---|
| 42,015 | 3/1864 | Nichols | 54/46 |
| 139,668 | 6/1873 | Hamil | 54/44 |
| 710,267 | 9/1902 | Graf . | |
| 767,003 | 8/1904 | Mason . | |
| 1,212,545 | 1/1917 | Nickel | 54/44 |
| 1,767,630 | 6/1930 | Warren . | |
| 2,008,977 | 7/1935 | Connolly | 54/44 |
| 3,088,259 | 5/1963 | Nuzzo | 54/44 |
| 3,293,828 | 12/1966 | Hessler | 54/44 |
| 3,438,177 | 4/1969 | Houston | 54/23 |
| 3,780,494 | 12/1973 | Nankivell, Jr. | 54/44 |
| 3,872,653 | 3/1975 | Thompson | 54/44 |

*Primary Examiner*—Robert P. Swiatek

*Attorney, Agent, or Firm*—Norvell E. Von Behren

[57] ABSTRACT

This invention relates to a new and improved handgrip and stirrup support device which serves as a substitute for a conventional saddle while mounting and riding horses bareback. The device is comprised of a wishbone or inverted V-shaped member having two semi-flexible, downwardly extending side members joined near their upper ends by a semi-circular union which also functions as a handgrip. The downwardly extending side members are angled away from each other in such a way that the device rests comfortably over the withers of the horse, and to these side members are attached stirrup straps for supporting stirrups, a girth strap, and a girth buckle strap, for supporting a grith buckle. The stirrups, the girth buckle, and the wishbone member itself are each made in the preferred embodiment from material comprised of plastic such as ABS/PC plastic. The stirrup straps, the girth strap, and the girth buckle strap, are each made of a webbed material such as nylon in the preferred embodiment. Among the advantages of the new and improved device are its very light weight, its highly economical cost, and the comfort, stability and security it provides to the rider.

10 Claims, 10 Drawing Figures

HAND GRIP AND STIRRUP SUPPORT DEVICE FOR BAREBACK HORSE RIDING

BACKGROUND OF THE INVENTION

This invention relates generally to an improved handgrip and stirrup support device for use while bareback riding. Horseback riding has long enjoyed wide popularity by men and women alike. Those who ride for leisure or for sport, often prefer the challenge and the feel of riding "bareback."However, while riding without a saddle makes riding to many more enjoyable, it poses certain difficulties for the horse and rider which can be disadvantageous. Typically, a rider with no stirrups or handgrip must grip the horse very tightly with his legs in order to maintain his balance. While this gripping helps to keep the rider from falling off the horse, or from being thrown, it can be very tiring after sustained periods of riding. In addition, it can be uncomfortable for the horse. Nor does it provide complete security to even the most experienced riders, should the horse buck or rear unexpectedly. Stability for the rider is particularly important, and especially where the safety of a novice is concerned.

The type of apparatus which has been previously used to help surmount some of these problems associated with bareback riding generally comprises a handgrip secured to the back of the horse by a girth strap, such as that shown in U.S. Pat. No. 3,438,177, issued Apr. 15, 1969 to J. D. Houston. An additional improvement to this device involves the use of a handgrip which permits the attachment of stirrups for the feet in order to further increase the rider's stability, such a combination being shown in U.S. Pat. No. 3,872,653, issued Mar. 25, 1975 to J. A. Thompson. Considering that the intended purpose of such devices is merely to serve as an aid to the bareback rider, they are typically bulkier than necessary, weighing between eight and ten pounds. Nor have such previous devices been inexpensive, because they are generally made with leather and metal parts. (It should be noted that while a typical western saddle costs around five or six hundred dollars, even the cheapest saddle generally sells for about two hundred fifty dollars.) Finally, previous devices have not been constructed in such a way as to afford the most convenient and comfortable placement on the horse's back, which is ideally right at the withers, i.e. the ridge between the horse's shoulder blades.

For a fuller understanding of other devices comprising lightweight saddles, harnesses, and training apparatus, the following U.S. patents may be generally useful: U.S. Pat. No. 767,003, issued to Henry M. Mason on Aug. 9, 1904; U.S. Pat. No. 767,630, issued to Roscoe F. Warren, filed Dec. 28, 1927; U.S. Pat. No. 710,267, issued to Alois Graf on Sept. 30, 1902.

SUMMARY OF THE INVENTION

In order to overcome the problems and disadvantages inherent in the prior devices herein before described, there is provided by the applicant's invention a greatly improved handgrip and stirrup support device for use during the bareback riding of horses. The device comprises an ABS/polycarbonate plastic inverted V-shaped or wishbone shaped part which functions as a handgrip for the rider, to which are attached two nylon webbed stirrup straps for supporting two ABS/polycarbonate plastic stirrups. The device is secured to the horse with a nylon webbed girth strap which is sewn around the device on one side, and attached by means of an ABS/polycarbonate plastic buckle and nylon webbed buckle strap on the other side.

The device is very lightweight, weighing in at approximately four pounds. The use of ABS/polycarbonate plastic parts, and nylon straps, make the device highly economical, probably selling for a total cost of under fifty dollars. In addition, the shape and size of the device allow very comfortable and convenient placement over the horse's withers. The device also serves several generally useful functions. It can be used by a trainer during the training of the horse, its supported stirrups being advantageous in this respect. It can also air the bareback rider in mounting the animal, and it is an effective substitute for a conventional saddle during riding. Finally, the device discourages the horse from lying down and then rolling over onto its back, which in certain circumstances is not a desirable motion for the horse.

The major component of the new device is comprised of an ABS/polycarbonate plastic inverted V-shaped or wishbone shaped part. Other types of plastic and other materials may also be used within the spirit and scope of the invention. The upper portion of the wishbone is an upright semi-circular ring designed to function as a comfortable handgrip for the rider, and to serve simultaneously as a point of union for the two lower, downwardly extending portions of the wishbone. These two downwardly extending portions are comprised of semi-flexible, ellipsoidally shaped, slotted side members which rest flatly against the horse's body. Attached to these slotted side members, by means of being wrapped through certain of the slots, are two nylon webbed stirrup straps for supporting two ABS/polycarbonate plastic stirrups. The wishbone part is secured to the horse with a nylon webbed girth strap which is wrapped in a novel way through certain of the slots of one side member, drawn under the belly of the horse, and then finally wrapped through the rings of an ABS/polycarbonate plastic buckle, which is in turn attached to the other side member by means of nylon webbing wrapped through certain of the slots in the side member and through the rings of the buckle.

The overall simplicity in construction, the use of plastics, and the use of nylon in the preferred embodiment, result in a comfortable, lightweight, and economical device. Furthermore, the device serves several useful functions. It is useful as an aid to riders when attempting to mount an unsaddled horse; one foot can be placed in a supported stirrup, while a hand can take hold of the secured handgrip. The device serves as replacement for a conventional saddle during riding. Because it supports stirrups, the device can also be used during the training of the animal by a trainer. Finally, the device is capable of deterring the horse from lying down in a small horse stall, and subsequently rolling over onto its back.

Accordingly it is an object of the invention to provide a new and improved handgrip and stirrup support device for use in bareback riding which is designed to be of optimum weight, i.e. as light a weight as is feasible given the available materials for construction.

Another object of the invention is to provide a new and improved handgrip and stirrup support device which is designed so as to be economical and hence affordable by a greater potential number of men and women desiring to ride horses bareback.

Still another object of the invention is to provide a new and improved handgrip and stirrup support device which enhances the comfort, safety, and stability of the bareback horse rider.

Yet another object of the invention is to provide a handgrip and stirrup support device made in such a way as to allow optimum positioning over the horse's withers thus enhancing the comfort of the animal.

Another object of the invention is to provide an improved device which can serve as a replacement for a conventional saddle during the mounting and riding of the animal.

Still another object of the invention is to provide a new and improved device which can be used by a trainer during the training of the horse.

Another object of the invention is to provide a new and improved device which will discourage a horse from rolling over onto its back when such a motion is not desirable.

These and other objects and advantages of the invention will become apparent from a study of drawings attached herewith and from a reading of the description of the preferred embodiment to be described more fully hereinafter.

BRIEF DESCRIPTION OF THE DRAWINGS

FIG. 2 shows the shape of the semi-circular handgrip at the top of the wishbone.

DESCRIPTION OF THE PREFERRED EMBODIMENT

Figure 1:
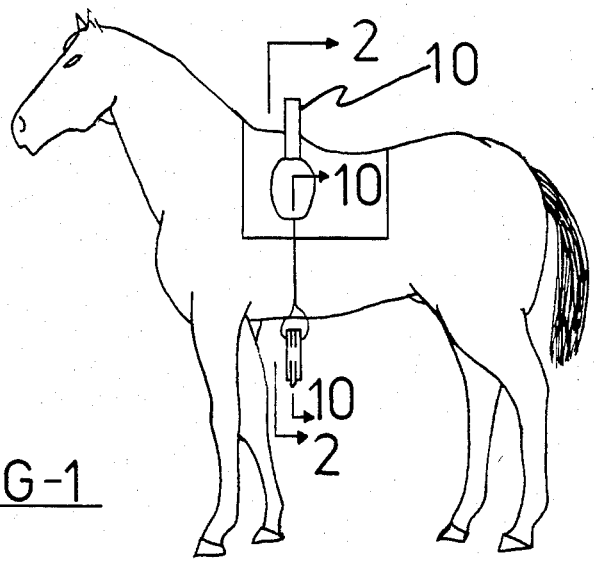
FIG. 1 is a side view of the new and improved handgrip and stirrup support device when properly positioned on the horse's back for bareback riding.
Figure 2:
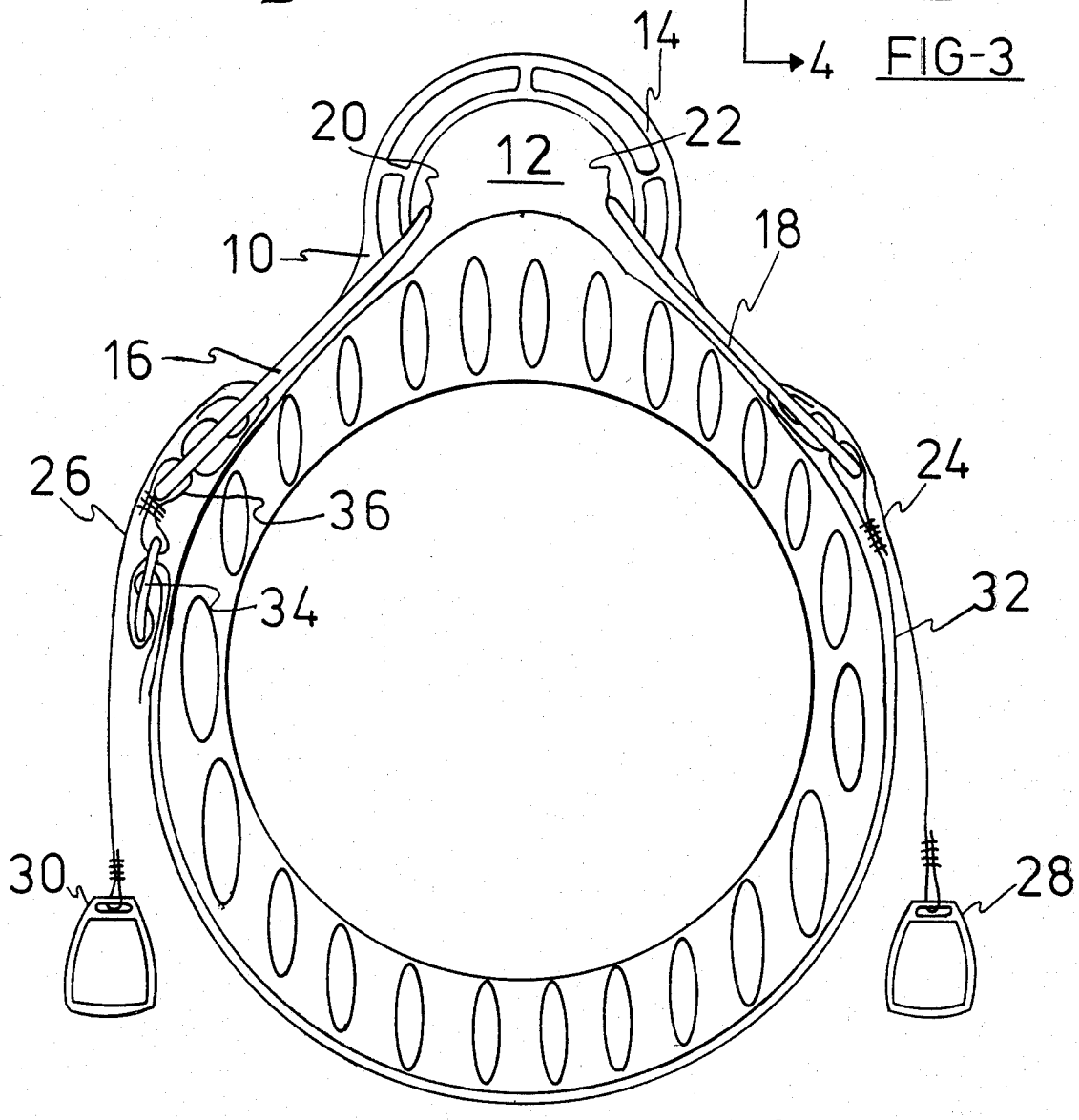
FIG. 2 is taken along line 2—2 of FIG. 1, showing the means by which the device is secured about the horse's body, the means by which the stirrup straps and stirrups are attached to it, and the approximate relative dimensions of the device and its parts in relation to the size of the animal. In addition.

Referring now to FIGS. 1 and 2 of the drawings, and especially to FIG. 2 there is shown the new and improved handgrip and stirrup support device designated generally by the numeral 10. The fundamental component of the device 10 is a wishbone-shaped member 12 made in its preferred embodiment of an ABS/polycarbonate plastic, in particular, an acrylonitrile-butadine-styrene/polycarbonate (ABS/PC) polyblend type material. Other materials may also be used within the spirit and scope of the invention. This material has a specific gravity of 1.12, a tensile strength of 8,400 psi, and a Rockwell hardness of R 120. It is evident from FIG. 2 that the handgrip 14 portion of the wishbone is a semi-circular ring in shape, and serves as a union for the two downwardly extending, slotted side members 16 and 18. These side members 16 and 18 are angled away from each other at an angle of approximately 90 degrees, and are tapered at their upper ends 20 and 22 to prevent irritation to the horse during mounting and riding.

To the side members 16 and 18 are attached nylon webbed stirrup straps 24 and 26. Other materials may be used for the straps 24 and 26 within the spirit and scope of the invention. These straps 24 and 26 each support similar ABS/polycarbonate plastic stirrups 28 and 30. Finally, the entire device 10 is secured to the horse by means of a nylon webbed girth strap 32, which is attached to the end of one side member 18 and drawn around the horse's belly and through an ABS/ploycarbonate plastic buckle 34 attached to the opposite side member 16 by means of a nylon webbed buckle strap 36. The materials used for the applicant's device are given by way of illustration only and other materials may be used within the spirit and scope of the invention.

Figure 3:
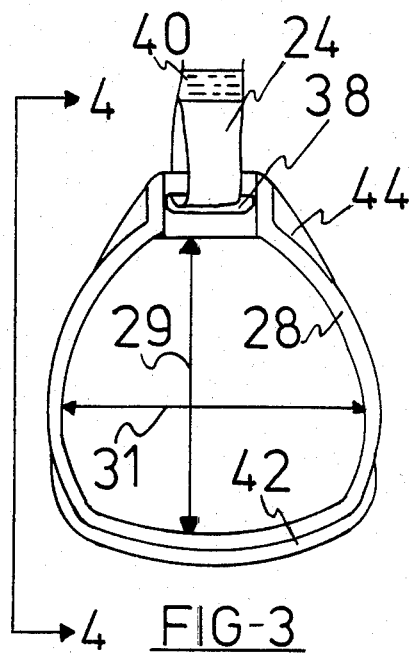
FIG. 3 is a more detailed front view of one single plastic stirrup attached to the stirrup strap.
Figure 4:
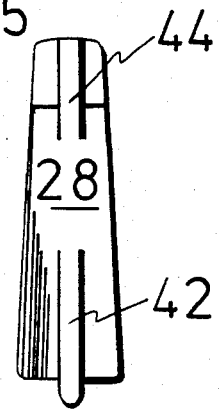
FIG. 4 is taken along line 4—4 of FIG. 3, and shows a side view of one single plastic stirrup. Both stirrups of the invention are similarly constructed.

Referring now to FIGS. 3 and 4, a single ABS/polycarbonate plastic stirrup 28 is shown. FIG. 3 shows that it has dimensions in the preferred embodiment of the about 5 inches in height as shown by the numeral 29, and $4\frac{1}{2}$ inches in width as shown by the numeral 31. The stirrup 28 is attached to a nylon webbed stirrup strap 24 which is looped through a slot 38 in the upper end of the stirrup 28, and then the strap 24 is sewn through a stitching point 40 to prevent disattachment of the stirrup 28. FIGS. 3 and 4 both show areas of additional molding 42 and 44 on the plastic stirrup 28 which serves to provide superior strength. Both stirrups 28 and 30 are similarly constructed.

Figure 5:
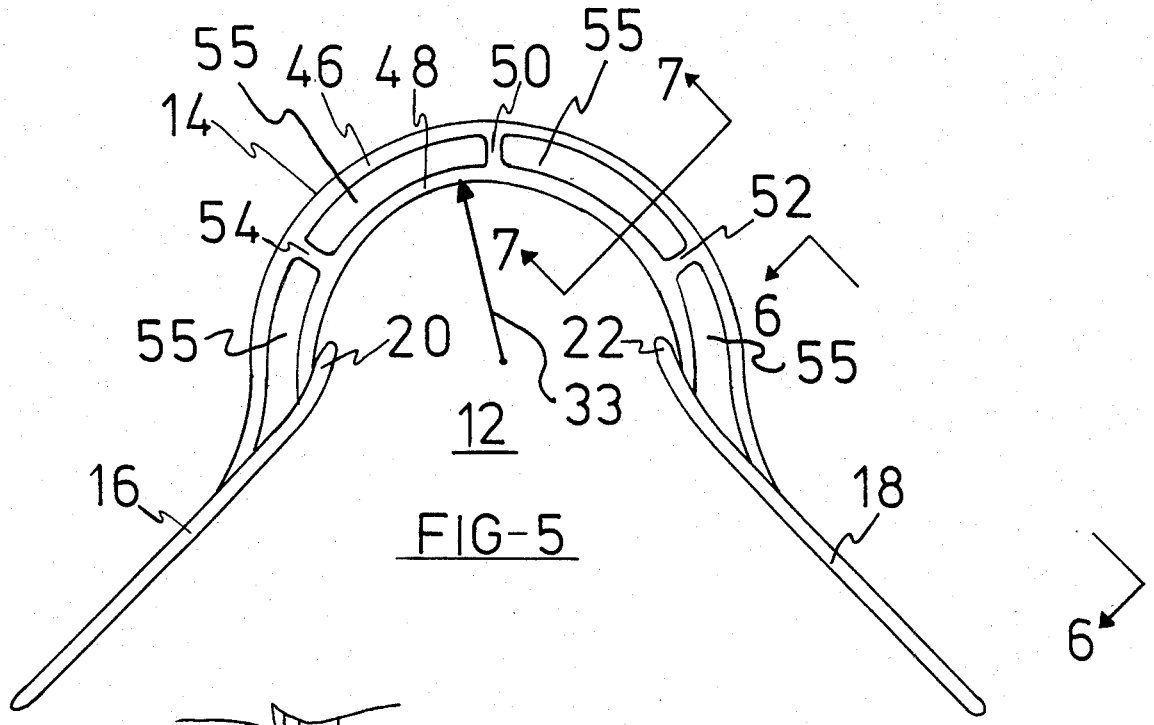
FIG. 5 is a more detailed view of a cross section of the plastic wishbone component of the handgrip and stirrup support device. At the top of the drawing is a longitudinal cross section of the semi-circular handgrip which serves as a union for the downwardly extending, slotted side members. The side members are shown to be tapered at their upper ends, and angled away from each other by approximately 90 degrees.
Figure 6:
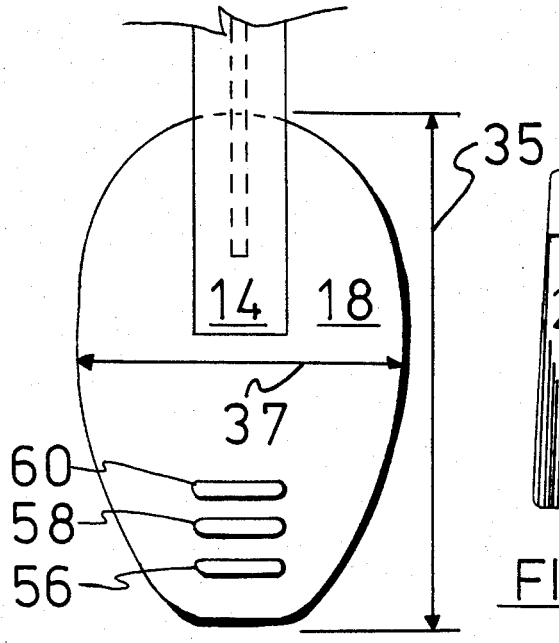
FIG. 6 is a side view of one plastic, semi-flexible, ellipsoidally shaped, slotted side member in its downwardly extended position. As it is shown, there are three horizontal slots in the lower end of the side member. Part of the union or handgrip is shown at the top of the figure. Both side members of the invention are similarly constructed.
Figure 7:
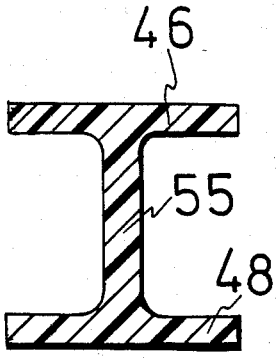
FIG. 7 is a sectional view of the handgrip taken along line 7—7 of FIG. 5 showing its double walled structure with a connecting web between the walls.

Referring now to FIGS. 5, 6 and 7, there are shown detailed views of the ABS/polycarbonate plastic wishbone 12, and its principal parts. The curvature of the semi-circular handgrip 14 has an approximately 3 inch radius in the preferred embodiment as shown by the numeral 33. In order to reduce its weight and increase its strength, the handgrip 14 has a double walled "I-beam" construction comprised of curved structural walls 46 and 48. These walls 46 and 48 are webbed in several places, with connecting webs 50, 52, 54, and 55. A cutaway view of this webbed construction is shown in FIG. 7 in which wall 48 is connected to wall 46 via a connecting web 55 to the "I-beam" piece depicted.

The handgrip 14 serves as a union for the two downwardly extending side members 16 and 18, and the entire wishbone 12 is a single piece. A side member 18 in its preferred embodiment is about 7½ inches across the long axis of its semi-ellipsoidal shape as shown by the numeral 35 in FIG. 6. The width of the side member 18 is about 5¼ inches as shown by the numeral 37 is FIG. 6. Both side members 16 and 18 are formed in a similar manner and are similar in size. FIG. 6 shows there are slots 56, 58 and 60 in the lower end of the side member 18. The lower side member 16 also has three slots 68, 69 and 71 as shown in FIG. 10.

Figure 9:
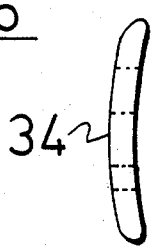
FIG. 9 is taken along line 9—9 of FIG. 8, and is a side view of the plastic buckle showing the approximate curvature of the buckle. The curvature prevents the buckle from sticking out from the horse due to the force on the buckle when the applicants device is tightened on the horse.
Figure 8:
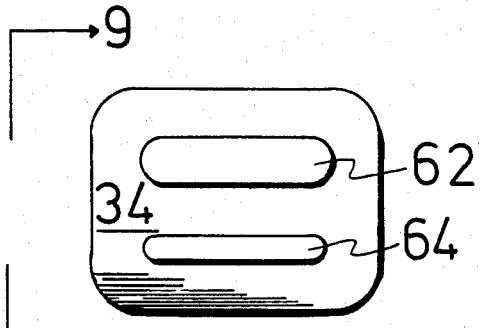
FIG. 8 is more detailed front view of the plastic buckle used to secure the girth strap to the device on one side.
Figure 10:
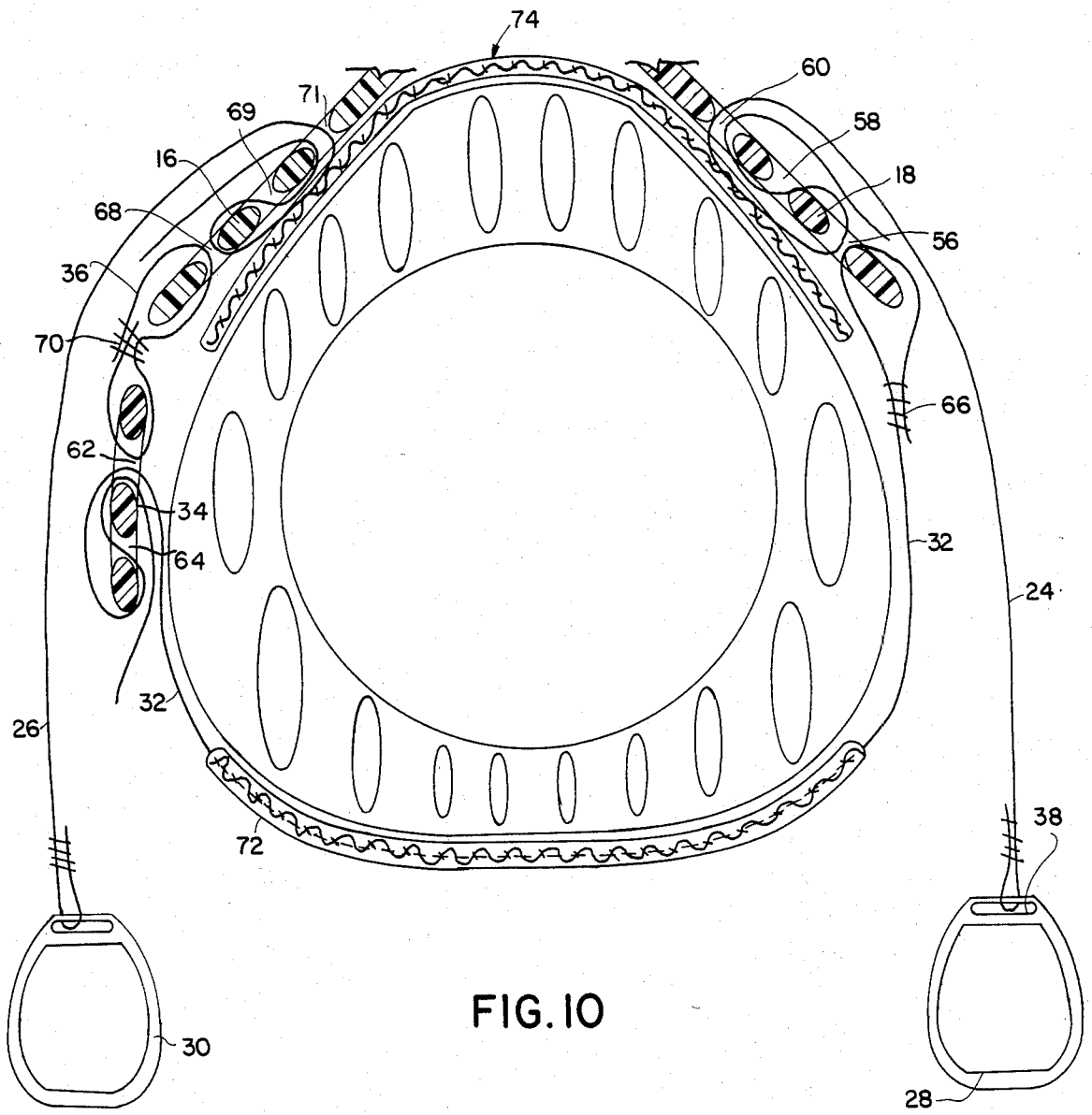
FIG. 10 is taken along line 10—10 of FIG. 1 and is a more detailed cross-sectional view of the handgrip and stirrup support device showing the means by which the nylon webbing of the stirrup straps, girth strap, and buckle strap are wrapped through the three slots of the downwardly extending side members, and showing where in some cases straps have been sewn at certain points to prevent their disattachment. The cross-sectional view of the buckle, which has two slots, is shown immediately below the left side member 16. In addition, the figure shows that the plastic stirrups are attached to the webbed stirrup straps which have been looped through a single slot at the top of the stirrup and then sewn. Finally, at the bottom of the figure against and in-between the horse's belly and the girth strap is shown an optional protective pad 72, while at the top of the figure underneath the wishbone part of the device itself is shown another optional protective pad 74.

Referring now to FIGS. 8, 9 and especially FIG. 10, there is shown in greater detail the means by which the device 10 with handgrip 14 and stirrups 28 and 30 is secured to the horse, and in addition, the means by which the stirrups 28 and 30 are supported. FIGS. 8 and 9 show the ABS/polycarbonate plastic girth strap buckle 34 which has two slots 62 and 64 in order to enable the use of straps in securing the device 10.

FIG. 10 illustrates the way in which the girth strap 32 is looped through side member 18 slot 56 and sewn at stitching point 66; the other end of the girth strap 32 is wrapped through girth strap buckle 34 slots 62 and 64 in such a way as to yield an adjustable friction tight fit. The girth strap buckle 34 is then attached to side member 16 by means of a buckle strap 36 which is looped through both side member 16 slot 68 and buckle slot 62 and sewn at a stitching point 70 to prevent disattachment.

The stirrup strap 24 is wrapped through side member 18 slots 60, 56 and 58 in such a way as to yield an adjustable friction tight length of strap extending to the stirrup 28. The other stirrup 30 is similarly attached to the other side member 16 by wrapping the stirrup strap 26 through the side member 16 slots 71, 68 and 69 yielding an adjustable friction fit length of strap extending to the stirrup 30.

Finally, FIG. 10 also shows an optional pad 72 in-between the horse's belly and the girth strap 32. The pad 72 may be slipped over the girth strap 32 since it is constructed tubular in shape. In addition, a second optional pad or blanket 74 is shown underneath the plastic wishbone component of the device. Both pads are useful in providing additional protection in preventing irritation to the animal.

In summary, there has been described in the foregoing patent application a novel invention comprising an improved handgrip and stirrup supporting device for use while riding horses bareback. The invention in its preferred embodiment is relatively simple in construction, very lightweight, and can be made economically. In addition, the device improves the safety, comfort, and security of the bareback rider while also allowing for comfortable positioning on the horse's back.

From the foregoing, it is apparent that all of the objects and advantages of the invention have been obtained by the new and novel device as described in the preferred embodiment and it should also be apparent that many changes can be made in the arrangement of the parts without departing from the spirit and scope of the invention as described in the following claims.

Having described my invention, I claim:

1. A handgrip and stirrup support device having a buckle, stirrups and other items attached thereto and for use while riding horses bareback comprising:

(a) a one-piece wishbone shaped member having two downwardly extending, semi-flexible side members with means for attaching straps, the side members being angled away from each other and being held in union by a handgrip which further comprises a semi-circular bridge having a size and diameter such that it can be gripped by a human hand;

(b) a girth strap, associated with the wishbone shaped member, with a means at one end for attachment to one of the two downwardly extending side members of the wishbone member and with means at the other end for attachment to the buckle;

(c) a buckle strap, associated with the wishbone shaped member, with means for attachment to one of the downwardly extending side members of the wishbone member and to the buckle;

(d) a buckle, associated with the buckle strap, with means for attachment to the buckle strap and the girth strap;

(e) two stirrup straps, associated with the wishbone shaped member, with means for attachment to the downwardly extending side members of the wishbone member;

(f) two stirrups, associated with the stirrup straps, with means for attachment to the two stirrup straps;

(g) means for attachment of the stirrup straps comprising wrapping said straps through three horizontal slots made in each of the downwardly extending side members; and (1) the wrapping of the stirrup straps through the three horizontal slots comprising inserting the upper end of each stirrup strap into the upper slot of each of the three side member slots immediately followed by insertion of the upper end of each strap into the lower of the three slots, immediately followed by reinsertion of the upper end of each strap into the middle slot and then the upper slot such that both the upper end of each stirrup strap and the balance of the strap length emerge from the upper of the three slots, and the means for attaching the girth strap to the buckle comprises a similar stepwise chain of insertions and wrapping of the end of the girth strap into the upper and lower slots of the buckle and around the bottom of the buckle.

2. The handgrip and stirrup support device as defined in claim 1 wherein the wishbone member, buckle and stirrups are made from material comprising acrylonitrile-butadine-styrene/polycarbonate (ABS/PC) plastic.

3. The handgrips and stirrup support device as defined in claim 2 wherein the girth strap, buckle strap and stirrup straps comprise webbed nylon.

4. A one-piece preformed semi-flexible member for use in a handgrip and stirrup support device used for bareback riding of a horse by a bareback rider, the member being positioned in front of the bareback rider and over the horse and not beneath the rider to thereby permit the rider to ride bareback using the semi-flexible member as a handgrip and stirrup support, and not as a saddle; the semi-flexible member having a generally inverted V-shaped configuration having a semi-circular portion formed at the apex of the V-shape and having two downwardly extending, semi-flexible side members depending from opposite ends of said semi-circular portion, each semi-flexible side member having formed therein a plurality of slots for use in supporting the stirrups; the semi-circular portion having a predetermined size and diameter such that it can be gripped by the hand of the bareback rider.

5. The semi-flexible member as defined in claim 4 wherein the member is formed from a plastic material having qualities when formed that permit the member to be semi-flexible.

6. The member as defined in claim 5 wherein the plastic material comprises an acrylonitrile-butadine-styrene/polycarbonate (ABS/PC) plastic.

7. The member as defined in claim 4 wherein the two downwardly extending semi-flexible side members are angled away from each other at approximately 90 degrees.

8. The member as defined in claim 7 wherein the semi-flexible side members have upper ends which do not come in contact with each other but are tapered away from each other toward the semi-circular portion whose semi-circular shape arches over the upper ends of the side members and joins the side members to the arch at semi-medial points.

9. The member as defined in claim 8 wherein the member is formed from a plastic material having qualities when formed that permit the member to be semi-flexible.

10. The member as defined in claim 9 wherein the plastic material comprises an acrylonitrile-butadine-styrene/polycarbonate (ABS/PC) plastic.

* * * * *